US007891909B2

(12) United States Patent
Tahar et al.

(10) Patent No.: US 7,891,909 B2
(45) Date of Patent: Feb. 22, 2011

(54) SEMI-SUBMERSIBLE OFFSHORE STRUCTURE

(75) Inventors: Arcandra Tahar, Houston, TX (US); Edward E. Horton, III, Houston, TX (US)

(73) Assignee: Horton Deepwater Development Systems, Inc., Houston, TX (US)

( * ) Notice: Subject to any disclaimer, the term of this patent is extended or adjusted under 35 U.S.C. 154(b) by 0 days.

(21) Appl. No.: 12/577,811

(22) Filed: Oct. 13, 2009

(65) Prior Publication Data

US 2010/0092246 A1 Apr. 15, 2010

Related U.S. Application Data

(60) Provisional application No. 61/104,545, filed on Oct. 10, 2008.

(51) Int. Cl.
*B63B 35/38* (2006.01)

(52) U.S. Cl. ..... 405/195.1; 114/266

(58) Field of Classification Search ..... 405/195.1; 114/264–266

See application file for complete search history.

(56) References Cited

U.S. PATENT DOCUMENTS 4,909,174 A 3/1990 Bowes
4,983,073 A * 1/1991 Petty et al. ..... 405/224
5,038,702 A * 8/1991 Bowes ..... 114/265
6,244,786 B1 * 6/2001 Johansson ..... 405/224.1
6,997,132 B2 * 2/2006 Steen ..... 114/265
7,011,472 B2 * 3/2006 Martensson et al. ..... 405/205
7,462,000 B2 * 12/2008 Leverette et al. ..... 405/223.1
2001/0026733 A1 * 10/2001 Ludwigson ..... 405/224.2
2002/0092456 A1 7/2002 Begnaud et al.
2005/0058513 A1 * 3/2005 Martensson et al. ..... 405/203
2005/0120935 A1 * 6/2005 Wybro et al. ..... 114/265
2005/0169714 A1 8/2005 Merchant et al.
2005/0217554 A1 * 10/2005 Steen ..... 114/265
2008/0190346 A1 * 8/2008 Krehbiel et al. ..... 114/264

OTHER PUBLICATIONS

International Search Report and Written Opinion for Appl. No. PCt/US2009/060417 dated May 20, 2010; (8 p.).

* cited by examiner

*Primary Examiner*—Tara Mayo-Pinnock
(74) *Attorney, Agent, or Firm*—Conley Rose, P.C.

(57) ABSTRACT

A semi-submersible offshore structure for offshore operations. In an embodiment, the structure comprises a buoyant hull. The hull comprises a first elongate horizontal pontoon having a longitudinal axis, a first end, and a second end. The pontoon includes a first node disposed at the first end of the pontoon, a second node disposed at the second end of the pontoon, and an intermediate section extending axially from the first node to the second node. Moreover, the first node has a width $W_1$, the second node has a width $W_2$, and the intermediate section has a width $W_3$ measured perpendicular to the longitudinal axis in bottom view. The width $W_3$ varies moving axially from the first node to the second node.

9 Claims, 12 Drawing Sheets

SEMI-SUBMERSIBLE OFFSHORE STRUCTURE

CROSS-REFERENCE TO RELATED APPLICATIONS

This application claims benefit of U.S. provisional application Ser. No. 61/104,545 filed Oct. 10, 2008, and entitled "Dog Bone Multi Column Floater," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The disclosure relates generally to floating offshore structures. More particularly, the disclosure relates to buoyant semi-submersible offshore platforms for offshore drilling and production. Still more particular, the disclosure relates to the geometry of the hull and pontoons of semi-submersible offshore platforms.

2. Background of the Technology

Most conventional semi-submersible offshore platforms comprises a hull that has sufficient buoyancy to support a work platform above the water surface, as well as rigid and/or flexible piping or risers extending from the work platform to the seafloor, where one or more drilling or well sites are located. The hull typically comprises a plurality of horizontal pontoons that support a plurality of vertically upstanding columns, which in turn support the work platform above the surface of the water. In general, the size of the pontoons and the number of columns are governed by the size and weight of the work platform and associated payload to be supported. The draft of an offshore structure generally refers to the vertical distance between the waterline and the bottom of the structure.

Conventional shallow draft semi-submersible offshore platforms are used primarily in offshore locations where water depth exceeds about 300 feet (91 meters). A typical shallow draft semi-submersible platform has a draft between 60 ft and 100 ft. (18.3 m and 30.5 m), and incorporates a conventional catenary chain-link spread-mooring arrangement to maintain its position over the well site. The motions of these types of semi-submersible platforms are usually relatively large, and accordingly, they require the use of "catenary" risers (either flexible or rigid) extending from the seafloor to the work platform, and the heavy wellhead equipment is typically installed on the sea-floor, rather than on the work platform. The risers have a catenary shape to absorb the large heave (vertical motions) and horizontal motions of the structure. Due to their large motions, conventional semi-submersible platforms usually do not support high-pressure, top-tensioned risers.

Increasing the draft of a semi-submersible offshore platform can improve its stability and reduce its range of movement. Doing so involves lengthening the columns and locating the pontoons at a greater depth below the surface of the water, where wave excitation forces are generally lower. As a result, a deep draft semi-submersible offshore platform (i.e., having a draft of at least about 150 feet (about 45 m)) usually has significantly smaller vertical and rotational motions than a conventional shallow draft semi-submersible platform, thereby enabling the deep draft platform to support top-tensioned drilling and production risers without the need for disconnecting the risers during severe storms. In addition, the surface area of the upper and lower surfaces of the pontoons can be increased, resulting in the vessel having a greater added mass, and hence, increased resistance to movement through the water and heave natural period. With increased heave natural period, the peak wave energy can be avoided.

In both conventional and deep draft types of semi-submersible offshore platforms, the hull is divided into several closed compartments, each compartment having a buoyancy that can be adjusted for purposes of flotation and trim. Typically, a pumping system pumps ballast water into and out of the compartments to adjust their buoyancy. The compartments are typically defined by horizontal and/or vertical bulkheads in the pontoons and columns. Normally, the compartments of the pontoon and the lower compartments of the columns are filled with water ballast when the platform is in its operational configuration, and the upper compartments of the columns provide buoyancy for the platform.

The location of final assembly of a semi-submersible offshore platform may involve integration of the hull (i.e., the pontoons and columns) and work platform (topside) at the shipyard (quayside), offshore at its operation site, or nearshore (integration site). For integration at the shipyard, the work platform is lifted and mounted to the hull with heavy lifting equipment (e.g., heavy lift crane), and then the fully assembled semi-submersible platform is transported to the operation site using a heavy lift or tow vessel. This approach may not be possible for deep draft semisubmersible platforms that have relatively long columns. For integration at the operation site, the hull is transported offshore to its operation site, either by towing it at a shallow draft, or by floating it aboard a heavy lift vessel. When the hull is at the operation site, it is ballasted down by pumping sea water into the pontoons and columns, and the work platform is then either lifted onto the tops of the columns by heavy lift cranes carried aboard a heavy lift barge, or by floating the work platform over the top of the partially submerged hull using a deck barge. In either case, the procedure is typically effected far offshore (e.g., 100 miles, or 161 km), is performed in open seas, and is strongly dependant on weather conditions and the availability of a heavy lift barge, making it both risky and expensive. For nearshore integration, the work platform is lifted and mounted to the hull with heavy lift cranes or heavy lift barge in the water close to the shore, and then the assembled platform is transported to the operation site. As compared to assembly at the operation site, nearshore assembly is generally less expensive and less risky. However, as the water is generally shallower proximal the shore, nearshore integration may not be possible for some deep draft semi-submersible structures due to the length of the columns—due to water depth, the hull may not be capable of being ballasted down far enough to allow mounting of the work platform to the hull with a heavy lifting crane or heavy lift barge.

During drilling or production operations, it is generally desirable to minimize the motion of the offshore platform to maintain the position of the platform over the well site and to reduce the likelihood of damage to the risers. One component of offshore platform motion is heave, which is the vertical linear displacement of the offshore platform in response to wave motion. For use in conjunction with top tensioned risers or dry tree solutions, the floating structure preferably has heave characteristics such that the strokes (relative motion between the hull and the buoyancy can or risers) and the tension of the risers are within acceptable limits. Further, for use in conjunction with steel centenary risers or wet tree solutions, the floating structure preferably has heave characteristics such that the riser fatigue and strength requirements are within acceptable limits.

For most semi-submersible floating structures, heave is governed by the draft of the structure and the geometry of the hull. As previously described, in general, the deeper the draft of the structure, the less heave. However, increasing the draft of the hull may inhibit the ability to employ quayside topside integration. Further, increasing the draft of the hull usually results in increased hull weight, as well as increased materials and manufacturing costs.

Accordingly, there remains a need in the art for a semi-submersible offshore platforms with acceptable heave characteristics in lower draft applications, and which can be manufactured more cost effectively.

BRIEF SUMMARY OF THE DISCLOSURE

These and other needs in the art are addressed in one embodiment by a semi-submersible offshore structure. In an embodiment, the structure comprises an equipment deck disposed above the surface of the water. In addition, the structure comprises a buoyant hull coupled to the equipment deck and extending below the surface of the water. The hull comprises a first vertical column and a second vertical column, each column having an upper end proximal the deck and a lower end disposed subsea. In addition, the hull comprises a first elongate horizontal pontoon having a longitudinal axis, a first end, and a second end opposite the first end. The pontoon includes a first node disposed at the first end of the pontoon and positioned below the lower end of the first column, a second node disposed at the second end of the pontoon and positioned below the lower end of the second column, and an intermediate section extending axially from the first node to the second node. Further, the first node has a width $W_1$ measured perpendicular to the longitudinal axis in bottom view, the second node has a width $W_2$ measured perpendicular to the longitudinal axis in bottom view, and the intermediate section has a width $W_3$ measured perpendicular to the longitudinal axis in bottom view. Moreover, the width $W_3$ varies moving axially from the first node to the second node.

These and other needs in the art are addressed in another embodiment by a semi-submersible offshore structure. In an embodiment, the structure comprises a work platform disposed above the surface of the water. In addition, the structure comprises a first vertical column and a second vertical column, each column extending from an upper end at the work platform to a lower end disposed subsea. Further, the structure comprises an elongate horizontal pontoon coupled to the lower end of the first column and the lower end of the second column. The pontoon has a longitudinal axis, a first end, and a second end opposite the first end. The pontoon includes a first node positioned below the lower end of the first column, a second node positioned below the lower end of the second column, and an intermediate section extending axially from the first node to the second node. Still further, the first node has a lower surface area $A_1$, the second node has a lower surface area $A_2$, and the intermediate section has a lower surface area $A_3$. Moreover, the ratio of area $A_3$ to the sum of the area $A_1$ and the area $A_2$ is between 0.45 and 0.60.

Thus, embodiments described herein comprise a combination of features and advantages intended to address various shortcomings associated with certain prior structures, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
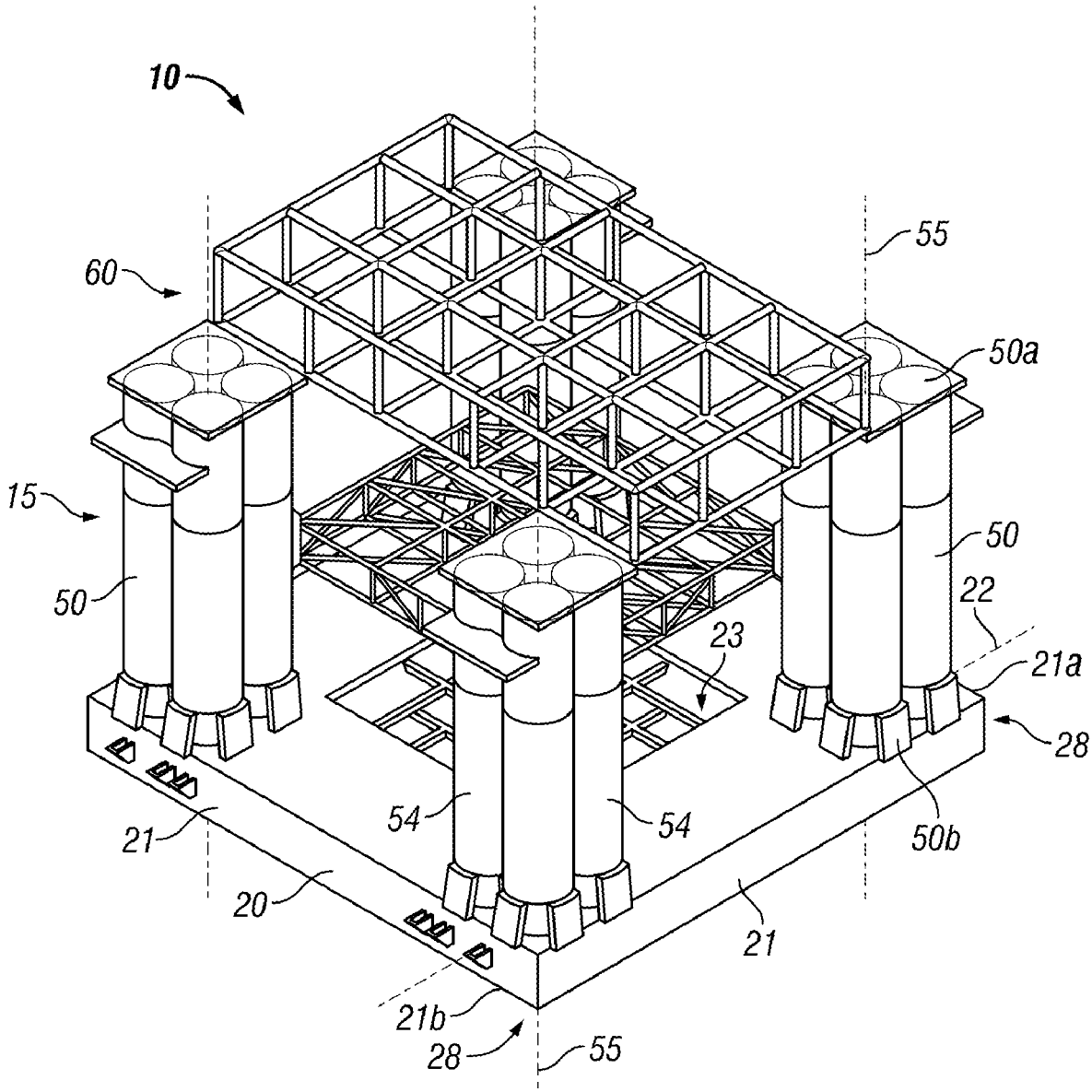
FIG. 1 (Prior Art)
FIG. 1 is a perspective view of a conventional semi-submersible multicolumn floating offshore platform.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis (e.g., the drillstring axis), while the terms "radial" and "radially" generally mean perpendicular to the central or longitudinal axis. For instance, an axial distance refers to a distance measured along or parallel to the central or longitudinal axis, and a radial distance refers to a distance measured perpendicularly from the central or longitudinal axis.

Figure 2:
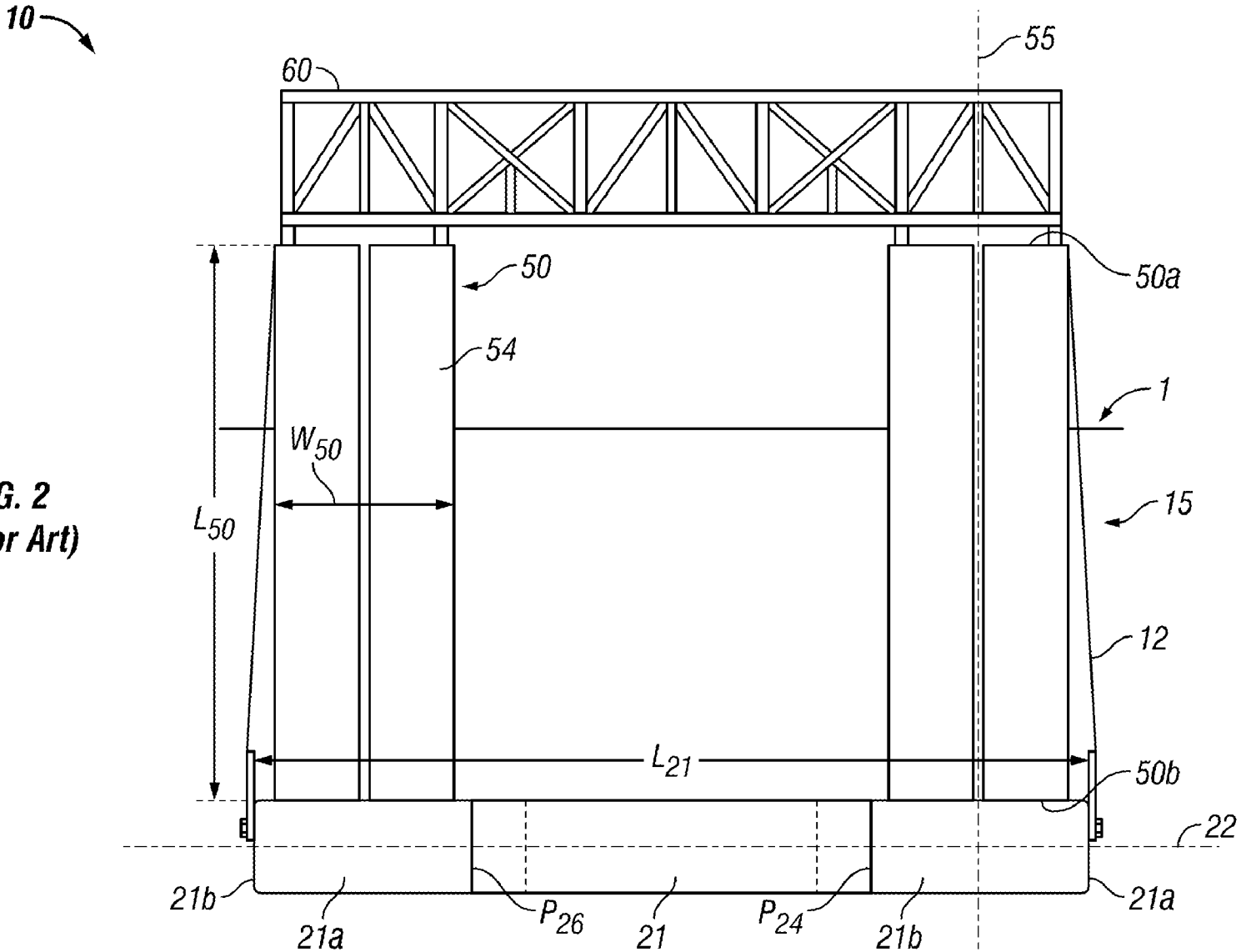
FIG. 2 (Prior Art)
FIG. 2 is a side view of the offshore platform of FIG. 1 deployed offshore.

Referring now to FIGS. 1 and 2, a conventional semi-submersible multicolumn floating offshore structure or platform 10 is illustrated. In FIG. 2, platform 10 is shown deployed in a body of water 1 in a deep draft operational configuration and anchored over an operation site with a taut leg mooring system 12. Offshore platform 10 comprises a floating hull 15 having an adjustably buoyant horizontal base 20 and a plurality of adjustably buoyant columns 50 extending vertically from base 20. A work platform or equipment deck 60 is mounted to hull 15 atop columns 50 when platform 10 is operationally deployed. The various equipment used in oil and gas drilling or production operations, such as a derrick, draw works, pumps, scrubbers, precipitators and the like are disposed on and supported by equipment deck 60.

Referring now to FIGS. 1-4, base 20 of hull 15 comprises a plurality of straight, elongated pontoons 21 connected end-to-end to form a closed loop base 20 with a central opening 23 through which risers may pass up to the equipment deck 60. In this particular design, four pontoons 21 are connected end-to-end to form a generally square base 20 having four corners 28 formed at the intersection of two pontoons 21. Each pontoon 21 extends between two columns 50 and includes ballast tanks that can be selectively filled with ballast water to adjust the buoyancy of base 20.

Figure 3:
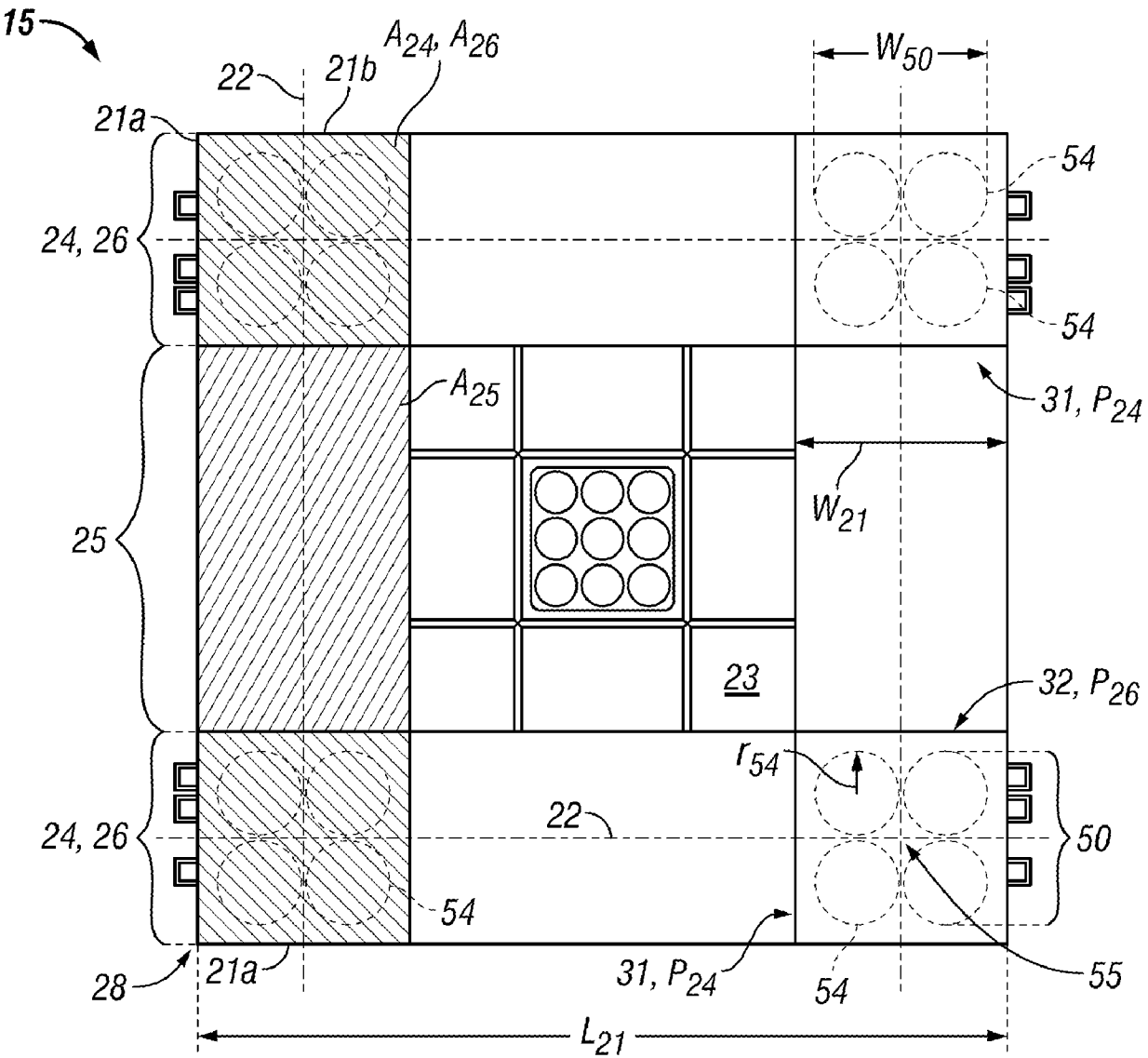
FIG. 3 (Prior Art)
FIG. 3 is a bottom plan view of the offshore platform of FIG. 1.
Figure 4:
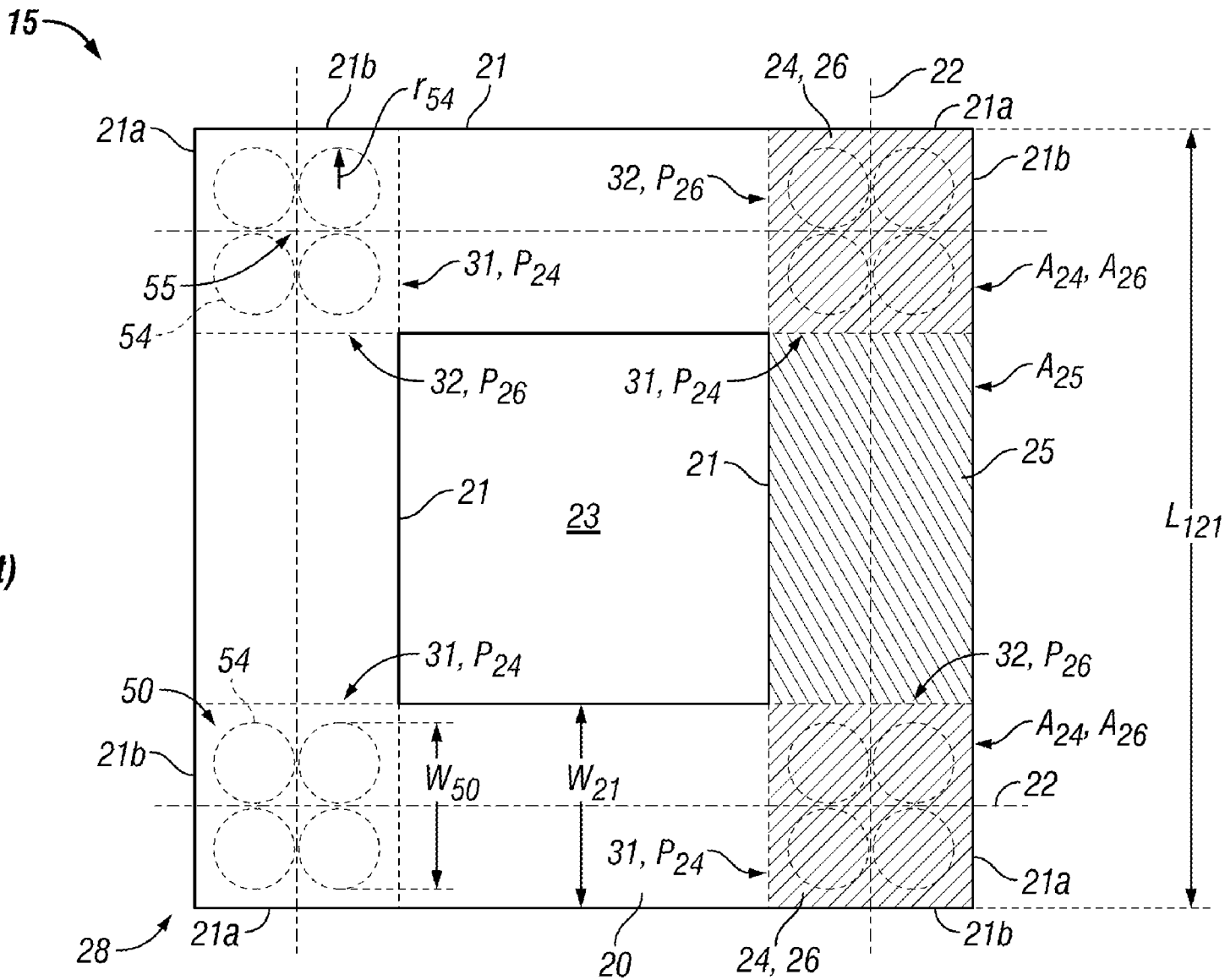
FIG. 4 (Prior Art)
FIG. 4 is a schematic bottom view of the hull of the offshore platform of FIG. 1.
Figure 5:
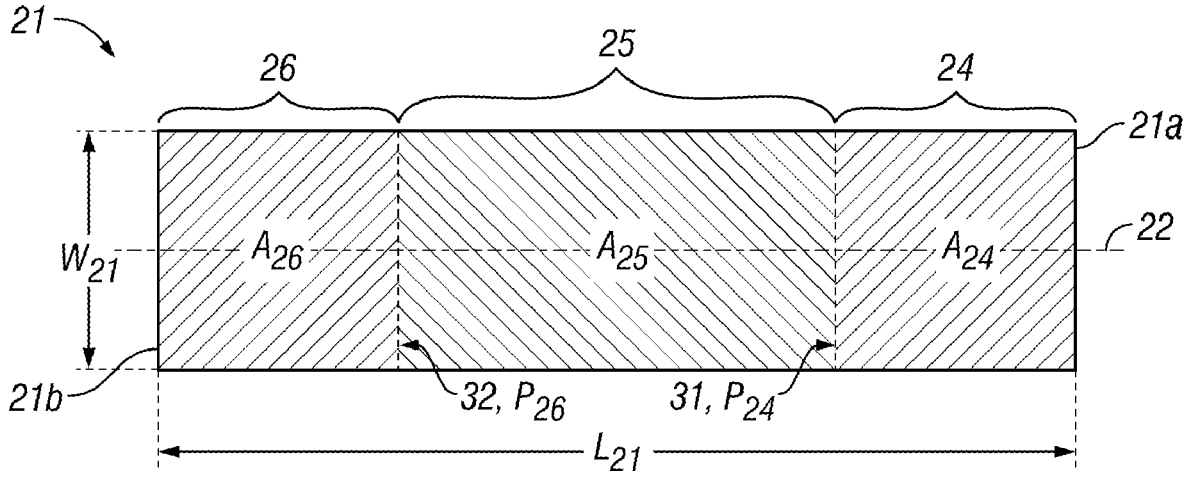
FIG. 5 (Prior Art)
FIG. 5 is a schematic bottom view of one of the pontoons of the offshore platform of FIG. 1.

Referring now to FIGS. 3-5, each pontoon 21 extends linearly along a central or longitudinal axis 22 between a first end 21*a* and a second end 21*b*. Each pontoon 21 has a length $L_{21}$ measured parallel to axis 22 between its ends 21*a, b*. In this conventional design, each pontoon 21 has the same length $L_{21}$.

As previously described, the four straight, elongated pontoons 21 are connected end-to-end to form a closed loop hull 15. In particular, each end 21*a, b* of each pontoon 21 intersects with one end 21*a, b* of another pontoon 21 to form corners 28. For example, as best shown in FIGS. 3 and 4, moving clockwise around base 20, second end 21*b* of a first pontoon 21 intersects first end 21*a* of a second pontoon 21, and second end 21*b* of second pontoon 21 intersects first end 21*a* of a third pontoon 21, and second end 21*b* of third pontoon 21 intersects first end 21*a* of the fourth pontoon 21.

Referring still to FIGS. 3-5, each pontoon 21 includes a first section or node 24 that underlies and supports one column 50, a second section or node 26 at the opposite end of pontoon 21 that underlies and supports another column 50, and an intermediate section 25 extending between nodes 24, 26. As is known in the art and as is used herein, the term "node" refers to the portion of a pontoon (e.g., pontoon 21) or hull base (e.g., base 20) that underlies and supports a column (e.g., column 50). Typically, the bounds of a node are defined by bulkheads, which divide or partition the pontoons or hull base into distinct compartments. In most cases, each node extends slightly beyond the perimeter of the column it supports. For hull bases that include straight pontoons or sides (e.g., triangular hull base, rectangular hull base, etc.), the nodes are usually disposed at the intersections of the pontoons in the corners of the hull base below the columns.

Moving axially from first end 21*a* to second end 21*b*, first node 24 extends axially from first end 21*a* to a bulkhead 31 generally coincident with a vertical plane $P_{24}$ perpendicular to axis 22 at the start of opening 24; intermediate section 25 extends axially from first node 24, bulkhead 31, and plane $P_{24}$ to second node 26 and a bulkhead 32 generally coincident with a vertical plane $P_{26}$ perpendicular to axis 22 at the end of opening 24. Thus, intermediate section 25 is the portion of each pontoon 21 that extends along opening 23, whereas nodes 24, 26 are the portions of each pontoon 21 that underlie columns 50 and intersect an adjacent pontoon 21. Due to the intersection of two pontoons 21 at each corner 28 and each node 24, 26, it should be appreciated that first node 24 of one pontoon 21 is coincident (and overlaps) with second node 26 of a different pontoon 21 in bottom view. Intermediate section 25 is the only portion of each pontoon 21 that does not intersect or overlap with another pontoon 21 in bottom view (FIGS. 3 and 4).

Referring still to FIGS. 3-5, in bottom view, the lower surface of each node 24 has a surface area $A_{24}$, the lower surface of each node 26 has a surface area $A_{26}$, and the lower surface of each intermediate section 25 has a surface area $A_{25}$. As used herein, the term "lower surface" refers to the surface of a structure visible in bottom view (i.e., as viewed from below generally parallel with the central axes of the columns). It should be appreciated that each node 24 is coincident with one node 26, and thus, the lower surface area $A_{24}$ of each node 24 is the same as the lower surface area $A_{26}$ of each node 26. In addition, each pontoon 21 has a width $W_{21}$ measured perpendicularly to its axis 22 in bottom view. In this conventional design, width $W_{21}$ of each pontoon 21 is constant or uniform along its entire length $L_{21}$. Thus, width $W_{21}$ in node 24, intermediate section 25, and node 26 is the same.

Referring again to FIGS. 1-4, each column 50 of the hull 15 extends linearly along a straight central or longitudinal axis 55 between a first or upper end 50*a* and a second or lower end 50*b*. Axis 55 of each column 50 is perpendicular to axis 22 of each pontoon 21. Deck 60 is attached to upper end 50*a* of each column 50, and base 20 is attached to lower end 50*b* of each column 50 at the intersection of each pair of pontoons 21. In particular, lower end 50*b* of each column 50 sits atop one node 24, 26 of each pontoon 21. In this design, each column 50 comprises a plurality of parallel, elongated tubulars 54 extending between ends 50*a, b* from deck 60 to base 20. Each tubular 54 includes a plurality of vertically stacked compartments, defined by bulkheads, that may be filled with solid ballast, ballast water, air or combinations thereof to adjustably control the buoyancy of each tubular 54 and column 50.

As best shown in FIGS. 2-4, each column 50 has a width $W_{50}$ measured perpendicular to axis 55 in side view (FIG. 2) and perpendicular to axis 22 of one of the pontoons 21 upon which it is attached in bottom view (FIG. 4). In this conventional design, width $W_{50}$ is constant or uniform along the entire length of each column 50, and further, each column 50 has the same width $W_{50}$. As best shown in FIG. 4, width $W_{21}$ of each pontoon 21 is slightly greater than width $W_{50}$ of each column 50. Each elongated, vertical tubular 54 is oriented parallel to axis 55 and has a radius $r_{54}$. Further, each tubular 54 is equidistant from axis 55 of its respective column 50. Since each column 50 is made from four tubulars 54 in this conventional design, tubulars 54 generally define square columns 50, where width $W_{50}$ of each column 50 is about four times radius $r_{54}$.

Figure 6:
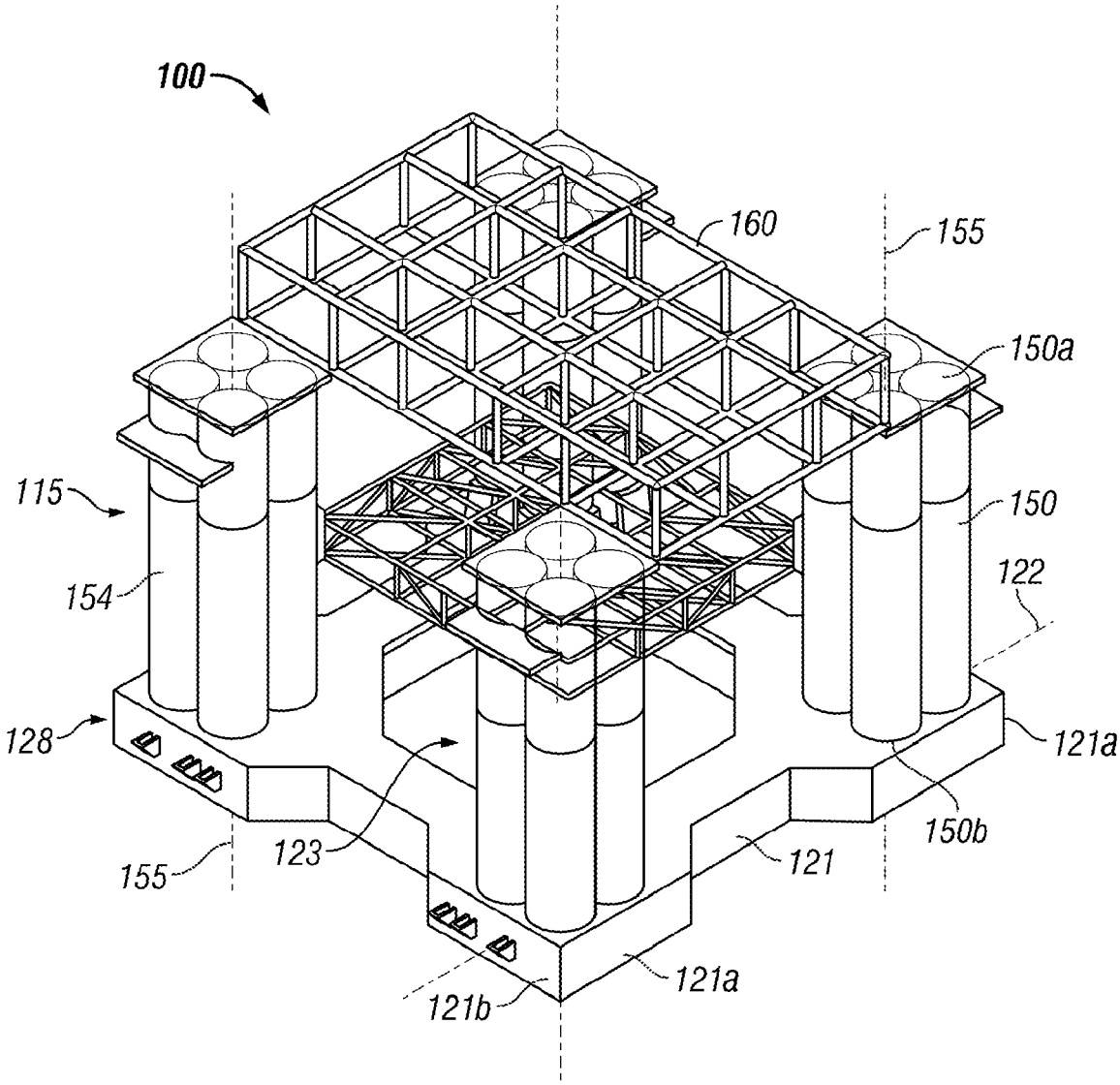
FIG. 6 is an embodiment of a semi-submersible multicolumn floating offshore platform in accordance with the principles described herein.
Figure 7:
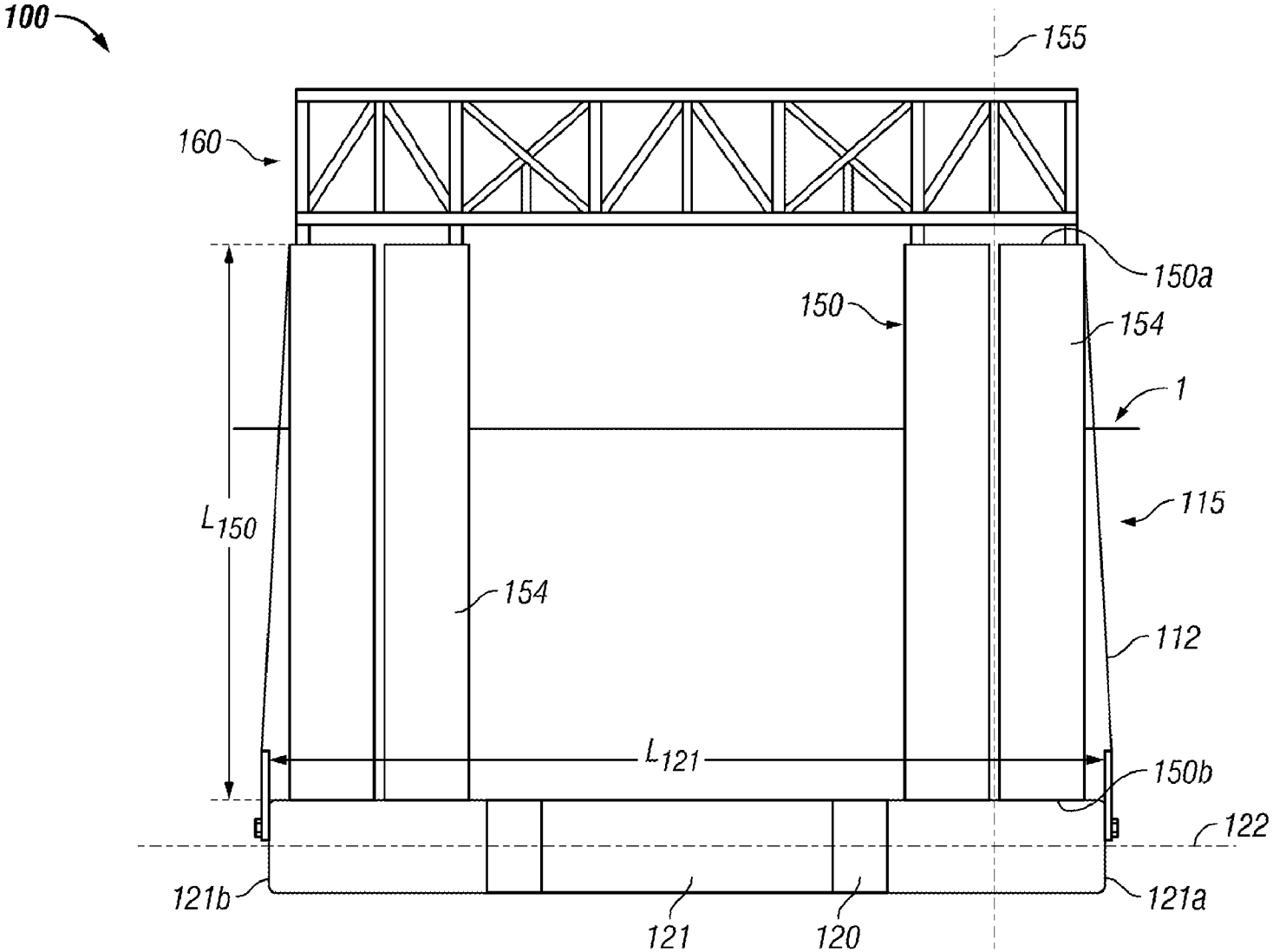
FIG. 7 is a side view of the offshore platform of FIG. 6.

Referring now to FIGS. 6 and 7, an embodiment of a semi-submersible multicolumn floating offshore platform 100 in accordance with the principles described herein is illustrated. In FIG. 7, platform 100 is shown deployed in a body of water 1 in an operational configuration and anchored over an operation site with a taut leg mooring system 112. However, in general, any suitable mooring system (e.g., catenary mooring, etc.) may be employed to restrict the motion of platform 100. Offshore platform 100 comprises a floating hull 115 having an adjustably buoyant horizontal base 120 and a plurality of adjustably buoyant columns 150 extending vertically from base 120. A work platform or equipment deck 160 is mounted to hull 115 atop columns 150 when platform 100 is operationally deployed. The various equipment typically used in oil and gas drilling or production operations, such as a derrick, draw works, pumps, scrubbers, precipitators and the like are disposed on and supported by equipment deck 160.

Referring now to FIGS. 6-9, base 120 of hull 115 comprises a plurality of straight, elongated pontoons 121 connected end-to-end to form a closed loop base 120 with a central opening 123 through which risers may pass up to the equipment deck 160. In this embodiment, four pontoons 121 are connected end-to-end to form a generally square base 120 having four corners 128 formed at the intersection of pontoons 121. Each pontoon 121 extends between two columns 150 and includes ballast tanks that can be selectively filled with ballast water to adjust the buoyancy of base 120.

Figure 8:
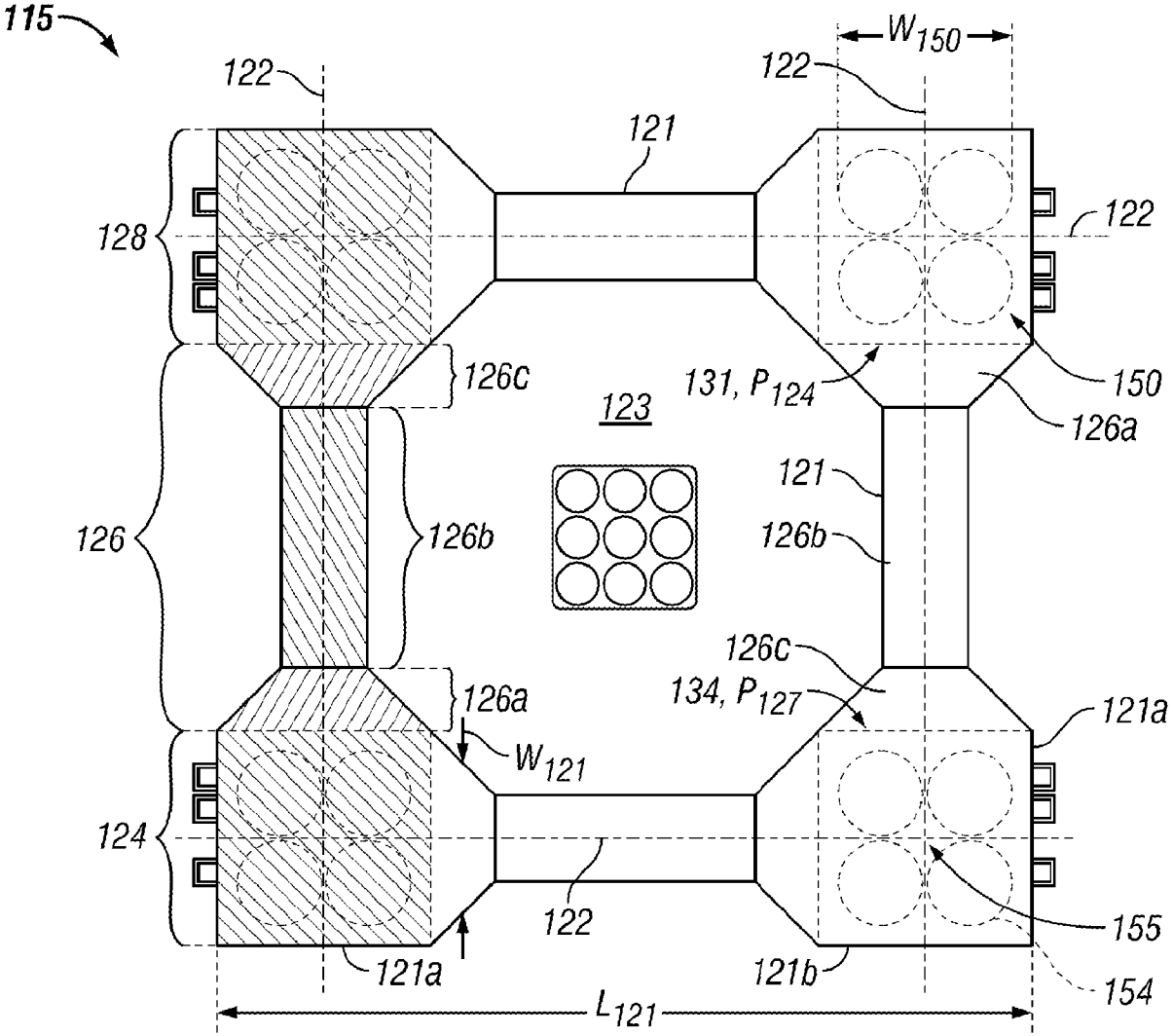
FIG. 8 is a bottom plan view of the offshore platform of FIG. 6.
Figure 9:
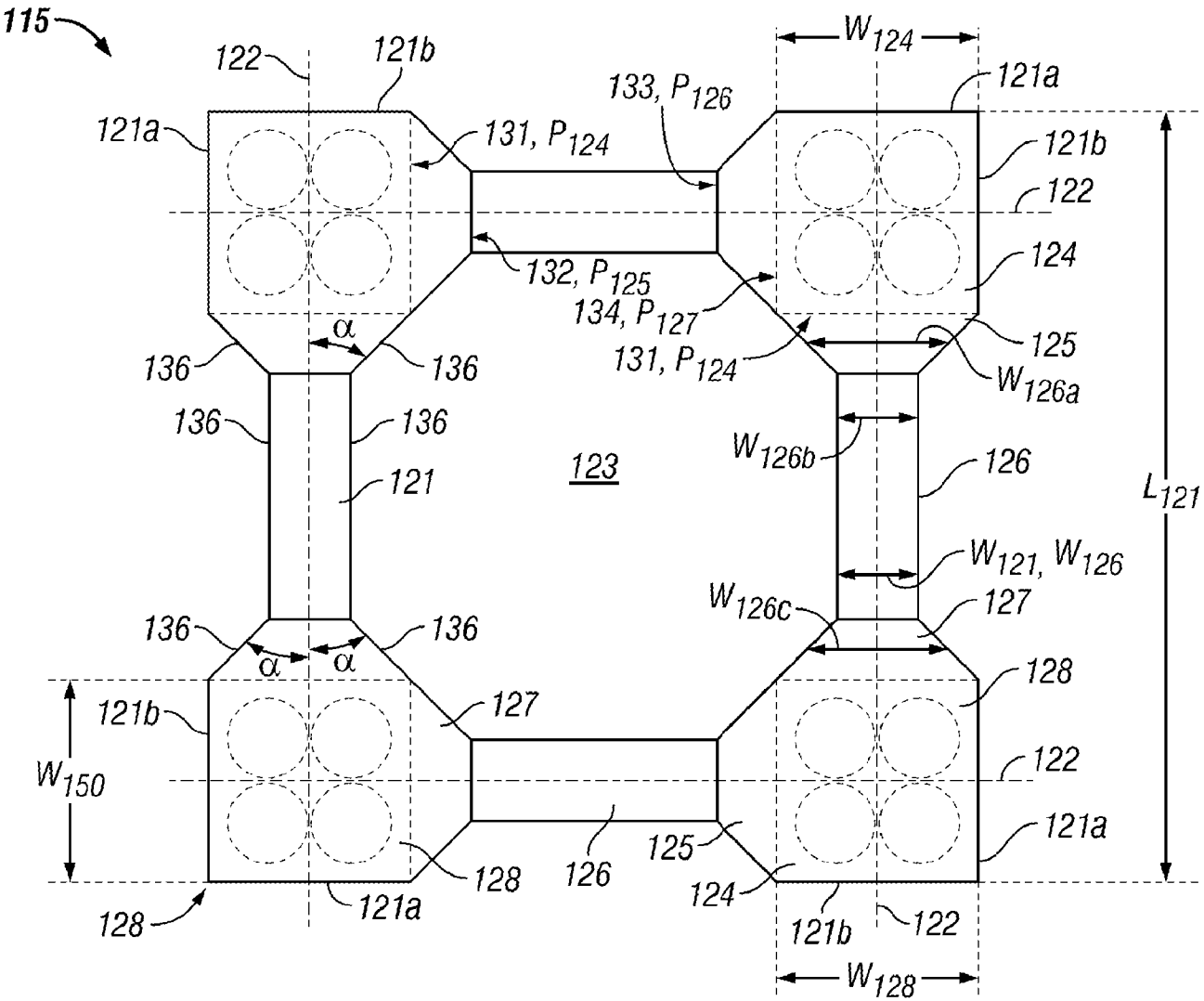
FIG. 9 is a schematic bottom view of the offshore platform of FIG. 6.
Figure 10:
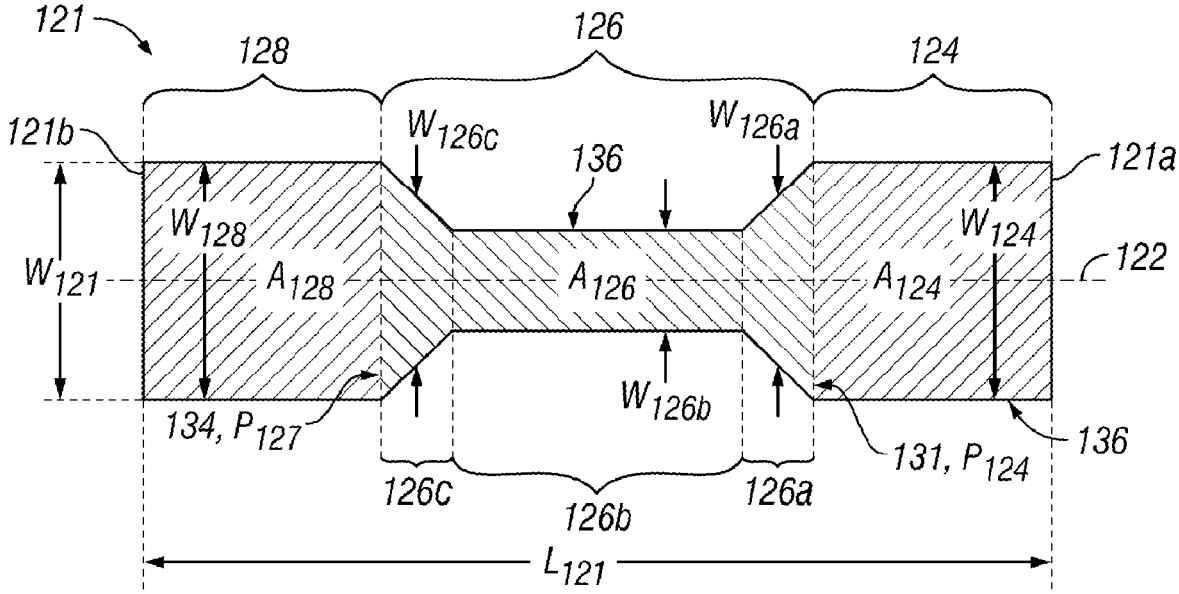
FIG. 10 is a schematic bottom view of one of the pontoons of the offshore platform of FIG. 6.

Referring now to FIGS. 8-10, each pontoon 121 supports two columns 150 and extends linearly along a central or longitudinal axis 122 between a first end 121*a* and a second end 121*b*. In this embodiment, each pontoon 121 is symmetric about its axis 122 in bottom view. Each pontoon 121 has a length $L_{121}$ measured parallel to axis 122 between its ends 121*a, b*. In this embodiment, length $L_{121}$ of each pontoon 121 is the same, however, in other embodiments, the length of one or more pontoons (e.g., length $L_{121}$ of one or more pontoons 121) may be different.

As previously described, the four straight, elongated pontoons 121 are connected end-to-end to form a closed loop hull 115. In particular, each end 121*a, b* of each pontoon 121 intersects with one end 121*a, b* of another pontoon 121 to form corners 128. For example, as best shown in FIGS. 8 and 9, moving clockwise around base 120, second end 121*b* of a first pontoon 121 intersects first end 121*a* of a second pontoon 121, and second end 121*b* of second pontoon 121 intersects first end 121*a* of a third pontoon 121, and second end 121*b* of third pontoon 121 intersects first end 121*a* of the fourth pontoon 121.

In this embodiment, pontoons 121 each have a rectangular cross-section taken perpendicular to its longitudinal axis 122. However, in general, the pontoons (e.g., pontoons 121) of offshore structures in accordance with the principles described herein may any suitable cross-section including, without limitation, circular, oval, triangular, etc.

Referring still to FIGS. 8-10, each pontoon 121 includes a first section or node 124 that underlies and supports one column 150, a second section or node 128 at the opposite end of pontoon 121 that underlies and supports another column 150, an intermediate section 126 extending axially from first node 124 to second node 128. Moving axially from first end 121*a* to second end 121*b*, first node 124 extends axially from first end 121*a* to intermediate section 126 and a bulkhead 131 generally coincident with a vertical plane $P_{124}$ perpendicular to axis 122; and second node 128 extends axially from second end 121*b* to intermediate section 126 and a bulkhead 134 generally coincident with a vertical plane $P_{127}$ perpendicular to axis 122. Due to the intersection of two pontoons 121 at each corner 128 and each node 124, 128, it should be appreciated that first node 124 of one pontoon 121 is coincident (and overlaps) with second node 128 of a different pontoon 121 in bottom view. Intermediate section 126 is the only portions of each pontoon 121 that does not intersect or overlap with another pontoon 121 in bottom view (FIGS. 8 and 9).

In bottom view, the lower surface of each node 124 has a surface area $A_{124}$, the lower surface of each node 128 has a surface area $A_{128}$, the lower surface of each intermediate section 126 has a surface area $A_{126}$. It should be appreciated that each node 124 is coincident with one node 128, and thus, the lower surface area $A_{124}$ of each node 124 is the same as the lower surface area $A_{128}$ of each node 128. Further, in this embodiment, lower surface area $A_{124}$, $A_{128}$ of each node 124, 128 is the same, and lower surface area $A_{126}$ of each intermediate section 126 is the same.

Referring still to FIGS. 8-10, each pontoon 121 has a width $W_{121}$ measured perpendicularly to its axis 122 in bottom view. Unlike pontoons 21 previously described, in this embodiment, width $W_{121}$ of each pontoon 121 varies along its length $L_{121}$ and central axis 122; first node 124 has a constant or uniform width $W_{124}$ and second node 128 has a constant or uniform width $W_{128}$, however, in intermediate section 126, width $W_{121}$ varies. In particular, each intermediate section 126 may be divided into a first transition portion 126*a* having a width $W_{126a}$, a second transition portion 126*c* having a width $W_{126c}$, and a middle portion 126*b* extending axially between transition portions 126*a, b* and having a width $W_{126b}$. Width $W_{126a}$ decreases in first transition portion 126*a* moving axially from first node 124 to middle portion 126*b*, width $W_{126a}$ decreases in second transition portion 126*c* moving axially from first node 124 to middle portion 126*b*, and width $W_{126b}$ is constant or uniform in middle portion 126*b*. In this embodiment, width $W_{124}$ and width $W_{128}$ are the same, however, width $W_{126b}$ is less than both width $W_{124}$ and width $W_{128}$. Further, width $W_{126a}$, $W_{126c}$ transitions from width $W_{124}$, $W_{128}$, respectively, to width $W_{126b}$. Thus, width $W_{121}$ of each pontoon 121 is a maximum in nodes 124, 128 (i.e., width $W_{124}$ and width $W_{128}$ each represent the maximum width of each pontoon 121), and a minimum in middle portion 126*b* of intermediate section 126 (i.e., width $W_{126b}$ represents the minimum width of each pontoon 121). Accordingly, each pontoon 121 may generally be described as having a "dog bone" shape in bottom view (FIG. 10).

As best shown in FIGS. 9 and 10, each pontoon 121 has a pair of lateral sidewalls 136 on either side of its axis 122 in bottom view. In transition portions 126*a, c*, lateral sidewalls 136 converge toward each other in bottom view as they extend toward intermediate section 126, and in intermediate section 126, lateral sidewalls 136 extend generally parallel to axis 122 in bottom view. Specifically, in transition portions 126*a, c*, each sidewall 136 are oriented at an acute angle $\alpha$ relative to axis 122 in bottom view. Angle $\alpha$ is preferably between 30° and 60°. In this embodiment of platform 100, each sidewall 136 is oriented at an angle $\alpha$ of about 45° within transition portions 126*a, c*.

Referring again to FIGS. 6-9, each column 150 of the hull 115 extends linearly along a straight central or longitudinal axis 155 between a first or upper end 150*a* and a second or lower end 150*b*. Axis 155 of each column 150 is perpendicular to axis 122 of each pontoon 121. Deck 160 is attached to upper end 150*a* of each column 150, and base 120 is attached to lower end 150*b* of each column 150 at the intersection of two pontoons 121. In particular, lower end 150*b* of each column 150 sits atop one node 124, 128 of each pontoon 121. In this embodiment, each column 150 comprises a plurality of parallel, elongated tubulars 154 extending between ends 150*a, b* from deck 160 to base 120. Each tubular 154 includes a plurality of vertically stacked compartments, defined by bulkheads (deck), that may be filled with solid ballast, ballast water, air or combinations thereof to adjustably control the buoyancy of each tubular 154 and each column 150.

Each column 150 has a width $W_{150}$ measured perpendicular to axis 155 in side view (FIG. 6) and perpendicular to axis 122 of one of the pontoons 121 upon which it is attached in bottom view (FIGS. 7 and 8). In this embodiment, width $W_{150}$ of each column 150 is the same, and is uniform along its entire length. Each elongated, vertical tubular 154 is oriented parallel to axis 155 and has a radius $r_{154}$. Further, in this embodiment, each tubular 154 is equidistant from axis 155 of its respective column 150. Since each column 150 is made from four tubulars 154 in this embodiment, tubulars 154 generally define square columns 150, where width $W_{150}$ of each column 150 is about four times radius $r_{154}$.

As previously described, the heave characteristics of an offshore floating structure (e.g., platform 10, platform 100) are influenced by the draft of the structure and the geometry of the structure. Regarding geometry, a critical factor affecting heave is the shape of the lower pontoons (e.g., pontoons 21), and in particular, the shape of the lower surface of the pontoons, which are subject to the vertical forces imposed by waves. The shape of the lower surface of a pontoon may be characterized by a "pontoon lower surface area ratio" defined as the ratio of the lower surface area of the pontoon excluding the nodes to the total lower surface area of the nodes of the pontoon as follows:

$$\text{Pontoon Lower Surface Area Ratio} = \frac{SA_{remainder}}{SA_{nodes}} = \frac{(SA_{pontoon} - SA_{nodes})}{SA_{nodes}},$$

where:

$SA_{nodes}$ is the sum of the lower surface areas of the nodes of the pontoon;

$SA_{remainder}$ is the lower surface area of the pontoon excluding the lower surface areas of the nodes of the pontoon; and $SA_{pontoon}$ is the lower surface area of the entire pontoon.

In the conventional pontoon design employed in offshore platform 10 previously described and shown in FIGS. 1-4, the sum of the lower surface areas of the nodes 24, 26 of one pontoon 21 is lower surface area $A_{24}$ plus lower surface area $A_{26}$, and the total lower surface area of the remainder of each pontoon 21 is area $A_{25}$. Thus, the pontoon lower surface area ratio for conventional pontoon 21 previously described is:

$$\frac{A_{25}}{(A_{24} + A_{26})}.$$

In the embodiment of platform 100 previously described, the sum of the lower surface areas of nodes 124, 128 of one pontoon is lower surface area $A_{124}$ plus lower surface area $A_{128}$, and the total lower surface area of the remainder of each pontoon 121 is lower surface area $A_{126}$. Thus, the pontoon lower surface area ratio for platform 100 previously described is:

$$\frac{A_{126}}{(A_{124} + A_{128})}.$$

For pontoon 21, as well as most conventional pontoons for semi-submersible offshore structures, the pontoon lower surface area ratio is typically between 0.75 to 1.0. However, for embodiments of "dog bone" shaped pontoons in accordance with the principles described herein (e.g., pontoons 121), the pontoon lower surface area ratio is preferably between 0.45 and 0.6. In particular, each pontoon 121 previously described has a pontoon lower surface area ratio of about 0.54.

The shape of the lower surface of each pontoon may also be characterized by a "minimum pontoon-to-column width ratio" defined as the ratio of the minimum width of the pontoon in bottom view measured perpendicular to the pontoons central or longitudinal axis to the width of a column supported by the pontoon at the intersection of the column and the pontoon (i.e., width of column footprint) in bottom view measured perpendicular to the pontoons central or longitudinal axis as follows:

$$\text{Pontoon-to-Column Width Ratio} = \frac{\text{Minimum Pontoon Width}}{\text{Column Width}}$$

In the conventional pontoon design employed in offshore platform 10 previously described, width $W_{50}$ of each column 50 is uniform along its entire length, and thus, the width of each column 50 at its intersection with pontoon 21 as measured perpendicular to axis 22 of pontoon 21 is width $W_{50}$. Further, width $W_{21}$ of each pontoon 21 is constant or uniform along its entire length, and thus, the minimum width of each pontoon 21 is width $W_{21}$. Thus, the pontoon-to-column width ratio for conventional pontoon 21 previously described is:

$$\frac{W_{21}}{W_{50}}.$$

In the embodiment of platform 100 previously described, width $W_{150}$ of each column 150 is uniform along its entire length, and thus, the width of each column 150 at its intersection with pontoon 121 as measured perpendicular to axis 122 of pontoon 121 is width $W_{150}$. Further, width $W_{121}$ of each pontoon 121 is at a minimum along middle portion **126*b*, and thus, the minimum width of each pontoon 121 is width $W_{126b}$. Thus, the pontoon-to-column width ratio for "dog bone" shaped pontoon 121** previously described is:

$$\frac{W_{126b}}{W_{150}}.$$

For pontoon 21, as well as most conventional pontoons for semi-submersible offshore structures, the pontoon-to-column width ratio is typically between 1.15 and 1.25. However, for embodiments of pontoon 121 of platform 100, the pontoon-to-column width ratio is preferably less than 1.0, and more preferably between 0.65 and 0.75. In particular, each pontoon 121 previously described has a pontoon-to-column width ratio of about 0.7.

As compared to pontoons employed in conventional semi-submersible offshore structures (e.g., pontoons 21 employed in platform 10), embodiments described herein including "dog bone" shaped pontoons (e.g., platform 100 including pontoons 121) offer the potential for a hull with reduced weight and reduced material requirements. Further, without being limited by this or any particular theory, by reducing the vertical area or surface area of the lower surface of the hull, it is believed that embodiments described herein offer the potential for reduced heave as compared to conventional offshore platforms, particularly in shallower draft applications (e.g., ~120 foot draft applications). By reducing draft without a substantial increase in heave as compared to a conventional designs, embodiments described herein also offer the potential increase the ease of quayside topside integration.

Without being limited by this or any particular theory, the preferred ranges for the pontoon lower surface area ratio and the pontoon-to-column width ratio offer the potential for a pontoon that experiences reduced heave, while providing sufficient strength and rigidity. For example, if the pontoon lower surface area ratio gets sufficiently small, implying the lower surface area of the pontoon outside the nodes is relatively small, the pontoon may not have sufficient strength and rigidity when subjected to subsea loads and torques. Likewise, if the pontoon-to-column width ratio gets sufficiently small, implying the minimum width of the pontoon is relatively small, the pontoon may not have sufficient strength and rigidity when subjected to subsea loads and torques.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

To further illustrate various illustrative embodiments of the present invention, the following example is provided.

EXAMPLE 1

Figure 11:
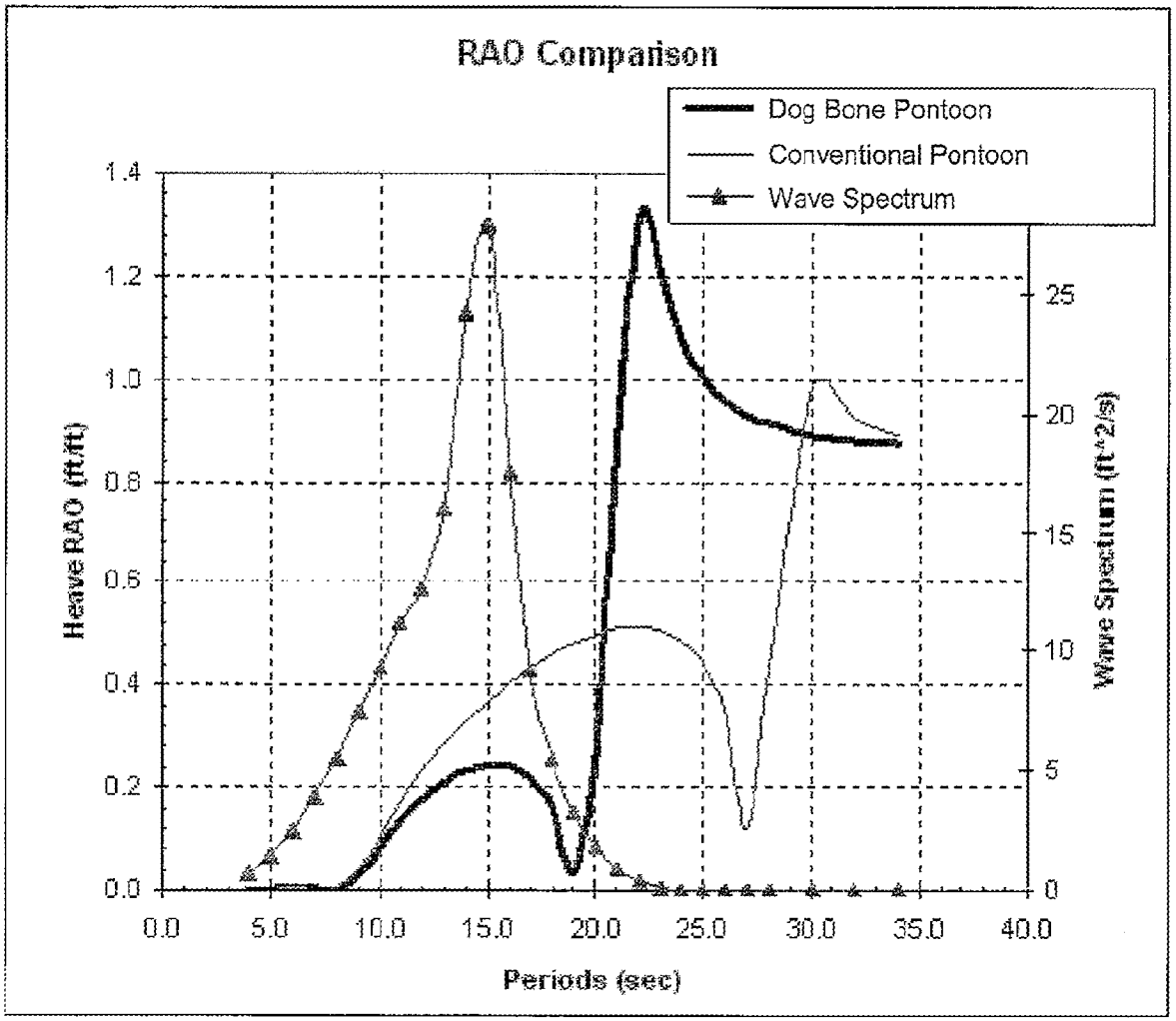
FIG. 11 is a graphical illustration comparing the Heave RAO of the offshore platform of FIG. 1 with the Heave RAO of the offshore platform of FIG. 6 for a given wave spectrum.
Figure 12:
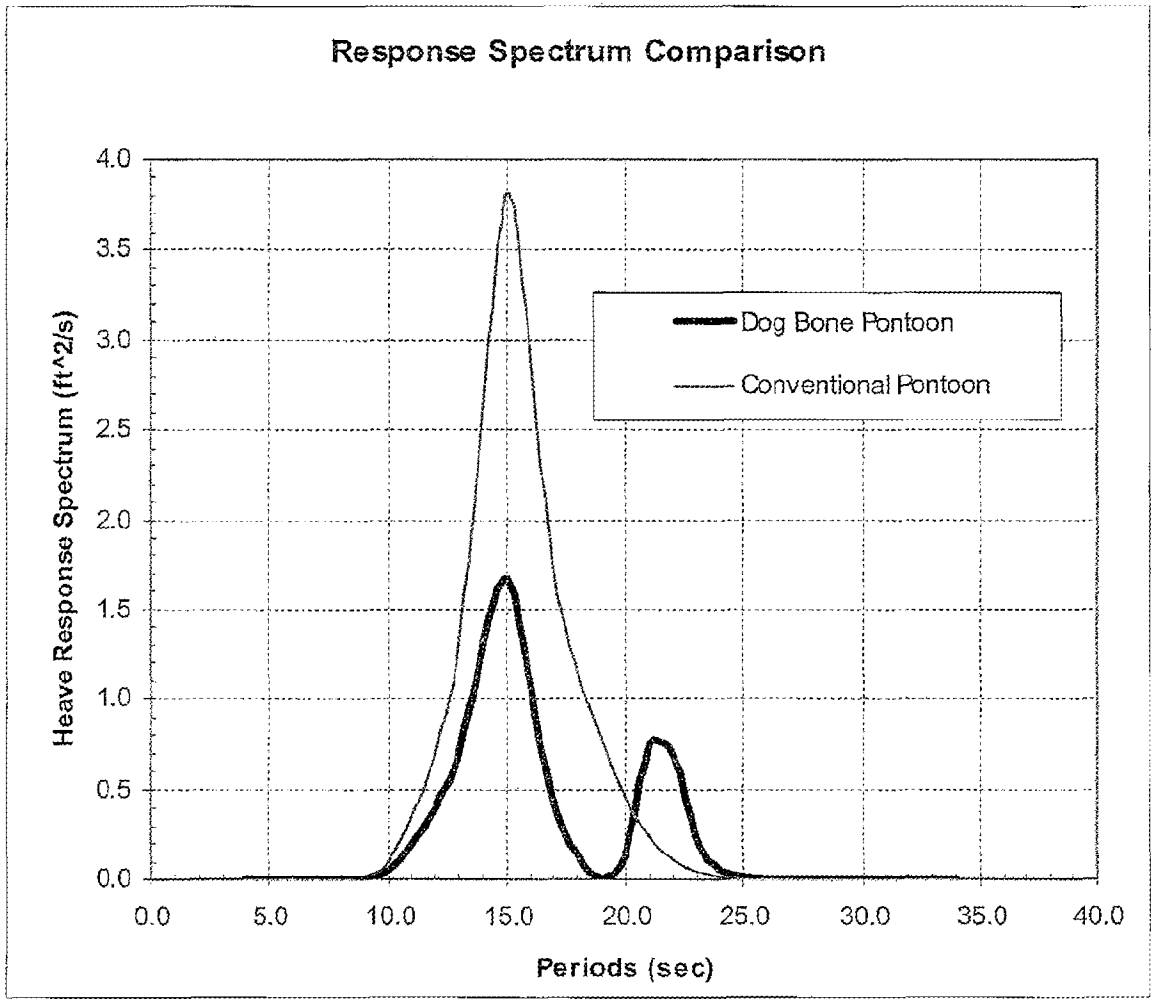
FIG. 12 is a graphical illustration comparing the Heave Response Spectrum of the offshore platform of FIG. 1 with the Heave Response Spectrum of the offshore platform of FIG. 6 for a given wave spectrum representative of a hundred-year hurricane.

To investigate the impact of the "dog bone" pontoon on heave motion, the motion response of a semi-submersible offshore structure having the shape and geometry of the embodiment of platform 100 previously described and shown in FIGS. 6 and 7 was modeled using WAMIT® wave interaction analysis tool available from WAMIT Inc. of Chestnut Hill, Mass., and then compared to a conventional semi-submersible offshore structure having the shape and geometry of platform 10 previously described and shown in FIGS. 1 and 2. In particular, the heave Response Amplitude Operator (RAO) of a platform 100 was compared with platform 10 for a given wave spectrum. Both platforms were modeled at 150 ft. (45.72 m) of draft. The heave RAO comparison is shown in FIG. 11. The heave RAO of platform 100 is less than the heave RAO of platform 10 for all wave periods less than about 20 seconds. At wave periods between about 15 seconds and 20 seconds, the heave RAO of platform 100 was about 48% less than the heave RAO of platform 10. As is known in the art, heave RAO is directly related to the expected heave motion of an offshore structure. Specifically, the heave RAO spectrum and the wave spectrum, the heave response spectrum can be derived as follows:

$$S_R(\omega)=[\mathrm{RAO}(\omega)]^2 * S(\omega)$$

where:

$S_R(\omega)$ is the heave response spectrum, $S(\omega)$ is the wave spectrum, and w is the wave frequency FIG. 12 shows the heave response spectrum for platform 100 and platform 10 in a 100 year hurricane. The square root of the area under the heave response spectrum curve is considered to be the root mean square (rms) value of the heave motion. Table 1 below shows a comparison of the rms value of heave motion for platform 100 and platform 10.

| Platform Type | Rms Value of Heave Motion (ft) |
|---|---|
| Platform 100 | 2.82 |
| Platform 10 | 4.11 |

What is claimed is:

1. A semi-submersible offshore structure, comprising:

an equipment deck disposed above the surface of the water;

a buoyant hull coupled to the equipment deck and extending below the surface of the water;

wherein the hull comprises:

a plurality of vertical columns, each column having an upper end proximal the deck and a lower end disposed subsea;

a plurality of elongate horizontal pontoons, each pontoon having a longitudinal axis, a first end, and a second end opposite the first end;

wherein each pontoon includes a first node disposed at the first end and positioned below the lower end of one of the plurality of columns, a second node disposed at the second end and positioned below the lower end of one of the plurality of columns, and an intermediate section extending axially from the first node to the second node;

wherein the first node of each pontoon has a width $W_1$ measured perpendicular to the longitudinal axis of the pontoon in bottom view, the second node of each pontoon has a width $W_2$ measured perpendicular to the longitudinal axis in bottom view, and the intermediate section of each pontoon has a width $W_3$ measured perpendicular to the longitudinal axis in bottom view;

wherein the width $W_3$ of each pontoon varies moving axially from the first node to the second node;

wherein the intermediate section of each pontoon includes a first transition portion, a second transition portion, and a middle portion extending axially from the first transition portion to the second transition portion;

wherein the first transition portion of each pontoon extends axially from the first node to the middle portion, and the second transition portion of each pontoon extends axially from the second node to the middle portion; and wherein the width $W_3$ of the intermediate section of each pontoon decreases in the first transition portion moving axially from the first node to the middle portion, and the width $W_3$ of the intermediate section of each pontoon decreases in the second transition portion moving axially from the second node to the middle portion.

2. The structure of claim 1, wherein the width $W_1$ of the first node of each pontoon is constant moving axially from the first end to the intermediate section, and wherein width $W_2$ of the second node of each pontoon is constant moving axially from the second end to the intermediate section.

3. The structure of claim 2, wherein the width $W_3$ of the intermediate section of each pontoon is constant in the middle portion moving axially from the first transition portion to the second transition portion.

4. The structure of claim 1, wherein each pontoon has a minimum width $W_{min}$ measured perpendicular to the longitudinal axis of the pontoon in bottom view, and the lower end of each column has a width $W_{column}$ measured perpendicular to the longitudinal axis of the pontoon in bottom view; and wherein the ratio of the width $W_{min}$ of each pontoon to the width $W_{column}$ of the corresponding column is less than 1.0.

5. The structure of claim 1, wherein the first transition portion of each pontoon and the second transition portion of each pontoon includes a pair lateral sidewalls on either side of the longitudinal axis of the pontoon in bottom view, wherein each lateral sidewall is oriented at an angle $\alpha$ relative to the longitudinal axis of the pontoon in bottom view, and wherein the angle $\alpha$ is between 30° and 60°.

6. The structure of claim 5, wherein the angle $\alpha$ is 45°.

7. The structure of claim 1, wherein the width $W_3$ of each pontoon is a minimum in the middle portion.

8. The structure of claim 7, wherein each pontoon has a minimum width $W_{min}$ measured perpendicular to the longitudinal axis of the pontoon in bottom view, and the lower end of each column has a width $W_{column}$ measured perpendicular to the longitudinal axis of the pontoon that is disposed below the column in bottom view; and wherein the ratio of the width $W_{min}$ to the width $W_{column}$ of each pontoon is between 0.65 and 0.75.

9. The structure of claim 1, wherein the first node of each pontoon has a lower surface area $A_1$, the second node of each pontoon has a lower surface area $A_2$, and the intermediate section of each pontoon has a lower surface area $A_3$; and wherein the ratio of area $A_3$ to the sum of the area $A_1$ and the area $A_2$ of each pontoon is between 0.45 and 0.60.

* * * * *